United States Patent [19]

Baumruck

[11] 4,260,971

[45] Apr. 7, 1981

[54] ELECTROMAGNETIC RELAY COMPRISING POSITIVELY GUIDED CONTACTS

[75] Inventor: Manfred Baumruck, Vienna, Austria

[73] Assignee: International Standard Electric Corporation, New York, N.Y.

[21] Appl. No.: 28,418

[22] Filed: Apr. 9, 1979

[30] Foreign Application Priority Data

Apr. 17, 1978 [AT] Austria ..... 2657/78

[51] Int. Cl.[3] ..... H01H 50/58

[52] U.S. Cl. ..... 335/128; 335/106; 335/203

[58] Field of Search ..... 335/128, 106, 133, 203, 335/127, 192, 199

[56] References Cited

U.S. PATENT DOCUMENTS 2,852,639 9/1958 Nelsen ..... 335/133

FOREIGN PATENT DOCUMENTS 1116556 6/1968 United Kingdom ..... 335/199

*Primary Examiner*—Harold Broome

*Attorney, Agent, or Firm*—John T. O'Halloran; Jeffrey P. Morris

[57] ABSTRACT

An electromagnetic relay to be mounted on a printed circuit, which has a small space requirement and is not susceptible to shocks is disclosed. It requires neither screw connections nor adjustment of the contacts as it is assembled and consists of only few components of simple shape.

8 Claims, 19 Drawing Figures

ELECTROMAGNETIC RELAY COMPRISING POSITIVELY GUIDED CONTACTS

BACKGROUND OF THE INVENTION

1. Field of the Invention

The invention relates to an electromagnetic relay which is preferably intended to be mounted on a printed circuit board and comprises an E-shaped magnetic core, which is provided with an operating coil, and a roof-shaped armature, which is movable into the magnetic field of the core and serves to actuate movable contact springs of contact spring sets and is connected to an armature return spring.

2. Description of the Prior Art

Whereas such relays are known, the known relays of that type have various disadvantages. Most of them are assembled from a large number of components, which often are intricately shaped so that they can be made only with the aid of expensive molds. The contact springs used in the contact spring sets of most relays must be adjusted as they are assembled. In most cases the assembling involves numerous operations, inclusive of screw connections, so that high costs are incurred.

Known relays of the type described first herein before occupy a relatively large area on a printed circuit board on which they are mounted and are often bulky so that when they occupy only a small area the volume of the relay can be accommodated only in a space of considerable height.

Another disadvantage of the known relays resides in their susceptibility to shock so that the contacts may be inadvertently actuated in response to a shock and this will result in trouble.

It is an object of the invention to provide a relay in which these disadvantages of the known relays are avoided and which affords also a high safety against an inadvertent operation of the contacts when the relay is subjected to a shock. Besides, the relay should have a small space requirement, require no screw connections and no adjustment of the contacts as it is assembled and consist of only few components of simple shape so that it can be assembled within short time.

SUMMARY OF THE INVENTION

This is accomplished according to the invention in that the armature is disposed on that side of the magnetic core which faces the movable contact springs, the movable contact springs are positively connected in the middle to an insulating body in an interior cavity thereof and carry contacts at both ends, contact carriers are provided, which are positively connected to the insulating body in the latter and register with the ends of the movable contact springs and have soldering tags protruding from the insulating body, and the armature is provided with actuating lugs, which are in register with the ends of the movable contact springs and are engageable with the latter by the movement of the armature. The advantages afforded by this design according to the invention reside mainly in that the arrangement of the armature between the magnetic core and the movable contacts of the contact spring sets enables a self-control of the contacts by a positive guidance in such a manner that the requirement is fulfilled that no closing switch is permitted to close when an opening switch cannot be opened because its contacts have been welded together and that no opening switch is permitted to close when the contacts of a closing switch have been welded together. Because the movable contact springs are secured in the middle in the interior cavity of the insulating body and the latter accommodates the armature and the contact spring sets, only a very small surface area is required for the fixation of the movable contact springs in the interior cavity of the insulating body and the free length of the movable contact springs can be increased for this reason so that the movable contact springs are subjected to a lower stress when actuated by the armature than conventional contact springs of smaller length.

Because the contact spring set in the relay according to the invention is not stacked, the relay may be flat and there is no need for screw connections to secure the contact spring set. As an adjustment is not required in the assembling of the relay according to the invention, the relay can be assembled within shorter time. This constitutes a further advantage afforded by the invention.

In accordance with a preferred feature of the invention the armature has the shape of a frame or is U-shaped. This symmetrical configuration of the armature affords the advantage that the mass of the armature is symmetrical with respect to its axis of symmetry so that the relay affords a high safety against an inadvertent actuation of the contacts in response to a shock to which the relay may be subjected. This is due to the fact that such shock cannot cause the armature to tilt so as to inadvertently actuate the contacts.

Further preferred features of the invention reside in that the armature return spring is secured at one end to the armature and at the other end to the magnetic core or in that the armature return spring has an angled end portion, which engages the armature in a notch at an end of the armature, whereas the other end of the spring is gripped in the insulating body and the armature return spring bears in the middle thereof on a bearing surface inside the insulating body. These features afford the advantage that the relay can be assembled in a very simple manner so that time and costs are saved.

According to a further preferred feature of the invention the magnetic core has lateral apertures and the insulating body has hook-shaped detent noses which are adapted to snap into said apertures.

Owing to this feature, the relay according to the invention can be assembled much more easily than known relays so that the assembling time can also be decreased.

According to a further preferred feature of the invention the armature is provided with bores, in which the actuating lugs are positively secured, or the actuating lugs are adhesively joined to the ends of the armature.

In this way, the actuating lugs can be joined to the armature in a simple manner without need for time-consuming assembling operations so that costs are saved too.

According to a further preferred feature of the invention the insulating body is provided with a dust-shielding plate, which covers the interior cavity of the insulating body, which cavity accommodates the contact spring sets, and said plate also separates the magnetic system from the contact spring sets and has openings through which the actuating lugs have access to the contact springs.

The dust-tight separation between the interior cavity of the insulating body, which cavity accommodates the contact spring sets of the relay, and that part of the relay in which the armature is disposed, affords a high safety against a soiling of the contacts by dust particles which might otherwise enter the interior cavity of the insulating body from the outside.

The electromagnetic relay according to the invention will now be described more fully with reference to an embodiment which is shown by way of example in FIGS. 1 to 15 of the drawings.

DESCRIPTION OF THE PREFERRED EMBODIMENTS

Figure 1A:
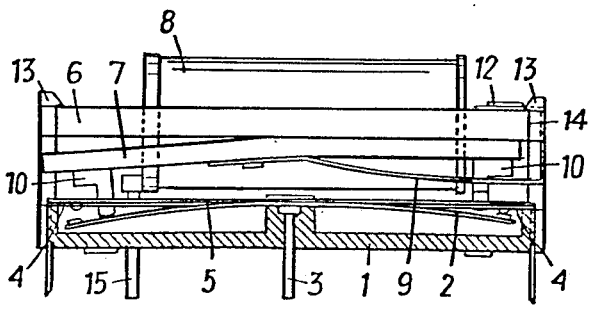
FIG. 1*a* is a front elevation of a relay according to the invention.
Figure 1C:
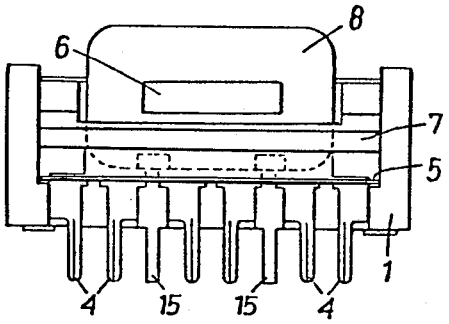
FIG. 1*c* is a side elevation of a relay according to the invention.
Figure 1B:
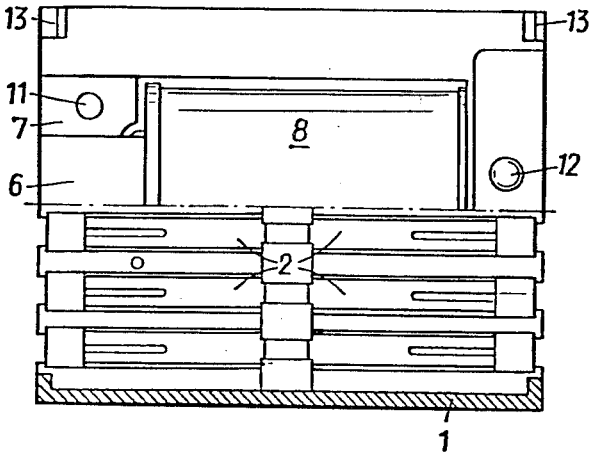
FIG. 1*b* is a top plan view of a relay according to the invention.
Figure 10:
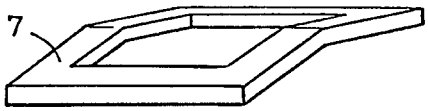
FIGS. 10 and 11 are perspective views showing armatures in the shape of a frame and in U-shape, respectively.

In FIG. 1, the insulating body 1 is shown in section. The movable contact spring 2 carries a soldering tag 3, which is press-fitted in the bottom of the insulating body 1 or is positively secured therein in a similar manner. The two contact carriers 4 are also secured by being press-fitted in the bottom of the insulating body 1. The movable contact spring 2 is provided with a soldering tag 3. The contact carriers 4 have soldering tags too. The interior cavity of the insulating body 1 accommodates the contact springs and is covered by a dust-shielding plate 5, which has apertures through which the actuating lugs 10 attached to the armature 7 extend so that they can actuate the movable contact spring 2. An armature return spring 9 is secured to the armature 7 and urges the armature toward its position of rest in known manner. The armature 7 has the shape of a frame, as shown in FIG. 10. The two legs of the armature return spring 9 are connected to the armature 7, which is angled in roof-shape. These spring legs hold the armature in position and when the relay drops out exert a restoring force to return the armature to its position of rest. Two actuating lugs 10 are positively secured to the armature 7 and extend through the openings in the dust-shielding plate 5 so that the lugs can actuate the movable contact spring 2.

Figures 3A, 3B, 3C:
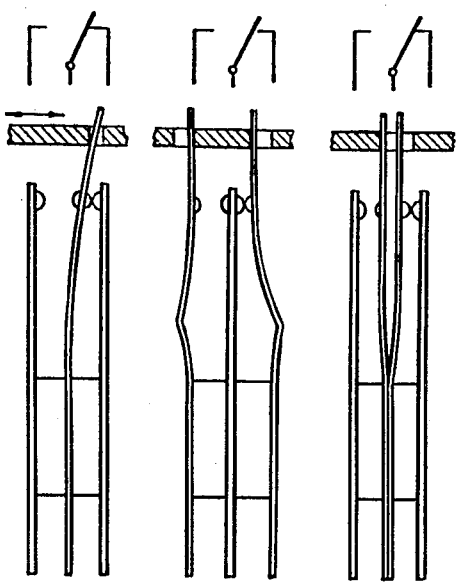
FIG. 3*a* is a known contact spring set of the prior art.
FIG. 3*b* is another known contact spring set of the prior art.
FIG. 3*c* is another known contact spring set of the prior art.
Figure 4:
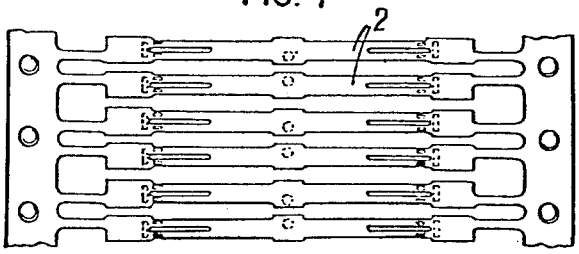
FIG. 4 shows an illustrative embodiment of the movable contact springs and the contact carriers of a contact spring set in that phase of their manufacture in which the contact springs have been punched from the spring plate and are still connected to each other.

An operating coil 8 is mounted on the middle leg of the E-shaped magnetic core 6 and has a coil former, which carries two soldering tags 15, which extend through bores in the insulating body 1. To facilitate the understanding of the difference between the contact spring set of the relay according to the invention and known contact spring sets, FIG. 3 shows three different embodiments of known contact spring sets and the means for actuating them. Most of such known contact spring sets consist of stacked contact springs, which are connected by screws to form a contact spring set, with insulating layers interposed. On the other hand, the contact spring set of the relay according to the invention consists of only two parts, namely, the box-shaped insulating body 1, on the one hand, and the contact carriers 4 shown in FIG. 4 and the movable contact spring 2, on the other hand. The contact carriers and contact spring are jointly made by punching from spring strip and are not separated from said strip until the relay is assembled. The known contact sets require more material than the contact set according to the invention. This larger material requirement is due to the large gripping surfaces and the fact that in change-over contacts three contact springs are required which are superimposed in approximately equal lengths. The connecting webs which are provided in each spring layer and must be cut off when the springs have been assembled are useless waste material in part. It is apparent from FIG. 4 that only two connecting webs are required in the contact spring set of the relay according to the invention so that a substantial saving of material and labor time is enabled compared to the known contact spring sets of conventional relays.

In known sets of contact springs which are stacked and connected by screws, the means for gripping the contact springs require a large space. In the relay according to the invention there is no need for bulky and expensive means for gripping the movable contact springs because these are symmetrical and are secured in the middle so that they are not unilaterally stressed.

Figure 5:
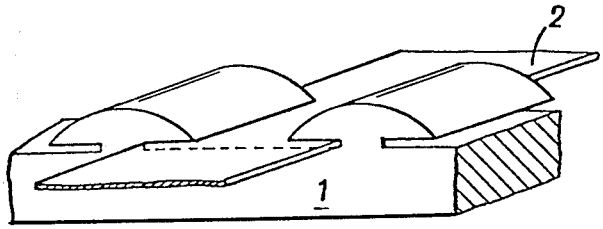
FIGS. 5 and 6 show two ways in which the movable contact spring can be secured in the insulating body.
Figure 6:
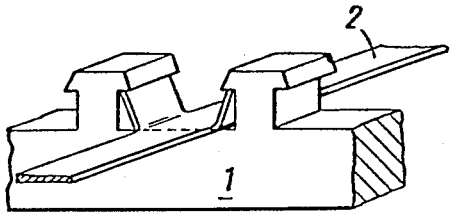
Figure 7:
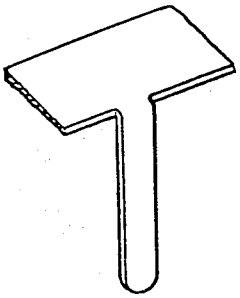
FIGS. 7, 8 and 9 show three different ways of making a soldering tag for a movable contact spring.
Figure 8:
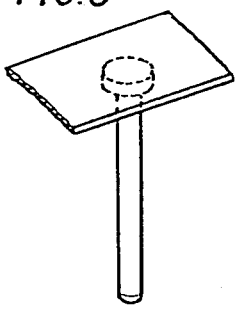
Figure 9:
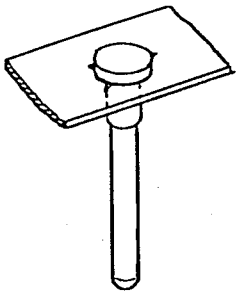

For this reason the movable contact springs can be secured to the insulating body 1 by press-fitting or fusion bonding, as is shown in two examples in FIGS. 5 and 6. As is apparent from FIGS. 7, 8 and 9, each of the movable contact springs 2 may be integrally formed with a lateral soldering tag or may be provided with a soldering tag which is press-fitted or joined by welding.

The movable contact springs 2 are flat spring plates, which need not be adjusted or bent. The contact pressure remains constant throughout the life of the relay because the spring material for the movable contact springs can be used without being initially cambered, as is usual with known contact springs.

To assemble the relay, the contact carriers 4 which have been angled are press-fitted in the slots provided for this purpose in the insulating body 1. These contact carriers have a tapered end portion, which protrudes outwardly and constitutes the soldering tag. Because the contact spring set of the kind described is very thin, the individual tolerances will not be cumulative as in the known stacked contact spring sets. This is an additional advantage.

Figure 2:
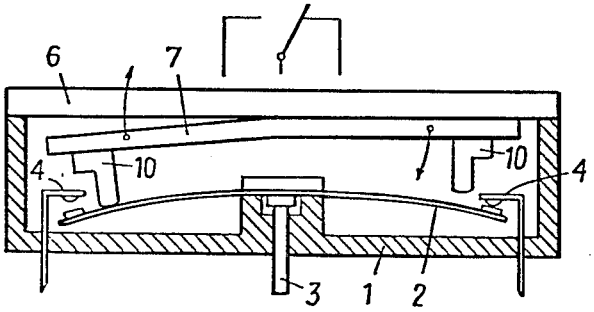
FIG. 2 shows the arrangement of a change-over switch comprising two stationary contact carriers and a movable contact spring together with the armature and the arrangement of these parts in the interior cavity of the insulating body.

FIG. 1 shows also how the armature return spring 9 can be secured to the magnetic core 6 by means of an embossed projection 12. The insulating body 1 has detent noses 13 with which it can be secured to the magnetic core 6. This is perspectively shown in FIG. 15 on a greatly enlarged scale. FIG. 2 is a greatly enlarged view showing a change-over switch. The insulating body 1 is shown in section so that it is apparent how the movable contact spring 2 is gripped in the middle and the soldering tag 3, the stationary contact carriers 4, the armature 7, the actuating lugs 10 secured to the armature, and the magnetic core 6 are visible.

FIGS. 5 and 6 are greatly enlarged views showing how the movable contact springs 2 can be positively secured to the insulating body 1.

Figure 11:
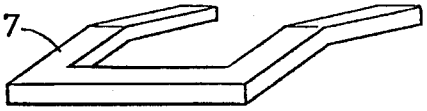

The relay according to the invention affords a very high safety against an inadvertent actuation of contacts in response to shocks to which the relay is subjected. Because the mass of the armature is symmetrically arranged, whether the armature has the shape of a frame or a U-shape, there is considerable safety that the shocks or shakes to which the armature may be subjected will not cause the armature to tilt and inadvertently actuate the contacts. FIGS. 10 and 11 are enlarged perspective views showing armatures which are frame-shaped and U-shaped, respectively, and indicating also the roof-shape of the armature.

Figure 12:
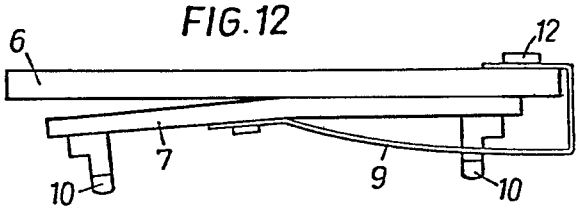
FIGS. 12, 13 and 14 show three ways in which the armature return spring can be secured to the armature, to the magnetic core, and to the insulating body.
Figure 13:
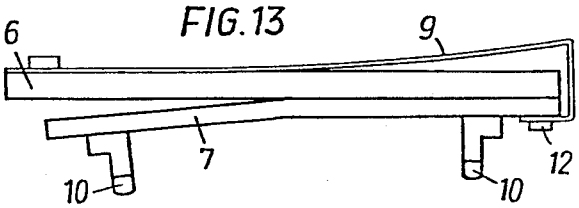

FIGS. 12 and 13 are greatly enlarged views showing two ways in which the armature return spring 9 can be secured at one end to the armature 7 and at the other end to the magnetic core 6 by embossed projections 12.

Figure 14:
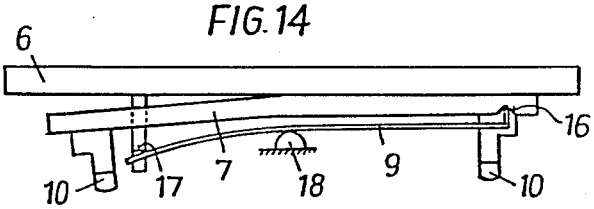

FIG. 14 is also a greatly enlarged view showing another fixation of the armature return spring 9. In this embodiment the armature return spring 9 has an angled end portion which engages the armature 7 in a notch 16. The other end of the armature return spring 9 is gripped in a slot 17 of the insulating body 1. The central portion of the armature return spring 9 bears on a bearing surface 18 inside of the insulating body 1.

Figure 15:
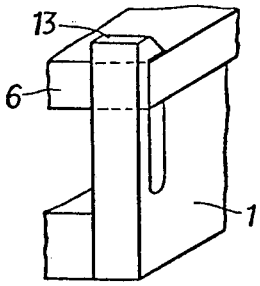
FIG. 15 shows the shape of the apertures in the magnetic core and of the detent noses of the insulating body. These parts serve to secure the insulating body to the magnetic core. Some of the figures of the drawings show details on a greatly enlarged scale.

FIG. 15 is a greatly enlarged view showing the fixation of the insulating body 1 to the magnetic core 6. The insulating body has detent noses 13, which engage the magnetic core from above. The insulating material of which the insulating body 1 consists is sufficiently elastically deformable so that the magnetic core and insulating body can be assembled without difficulty.

I claim:

1. An electromagnetic relay, mountable on a printed circuit board and including an E-shaped magnetic core, having an operating coil, and a roof-shaped armature, which is movable into the magnetic field of the core and serves to actuate movable contact springs of contact spring sets and is connected to an armature return spring, comprising:

armature means disposed on that side of the magnetic core facing said movable contact springs, said movable contact springs being positively connected substantially in the middle thereof to an insulating body in an interior cavity thereof and carry contacts at both ends;

contact carrier means positively connected to said insulating body in the latter and register with the ends of said movable contact springs; and having soldering taps protruding from said insulating body, said armature being provided with actuating lugs, which register with the ends of said movable contact springs and are engageable with the latter by the movement of the armature; and armature return spring means having an angled end portion engaging the armature in a notch at an end of the armature; and wherein the other end of the spring is gripped in the insulating body and the armature return spring bears in the middle thereof on a bearing surface inside the insulating body.

2. An electromagnetic relay according to claim 1, wherein the armature is U-shaped.

3. An electromagnetic relay according to claim 1, wherein the armature is shaped into a frame.

4. An electromagnetic relay according to claim 1, wherein the armature return spring is secured at one end to the armature and at the other end to the magnetic core.

5. An electromagnetic relay according to claim 1, wherein the magnetic core includes lateral apertures and the insulating body includes hook-shaped detent noses which are adapted to snap into said apertures.

6. An electromagnetic relay according to claim 1, wherein the armature includes bores wherein actuating lugs are positively secured.

7. An electromagnetic relay according to claim 1, wherein the actuating lugs are adhesively joined to the ends of the armature.

8. An electromagnetic relay, mountable on a printed circuit board and including an E-shaped magnetic core, having an operating coil, and a roof-shaped armature, which is movable into the magnetic field of the core and serves to actuate movable contact springs of contact spring sets and is connected to an armature return spring, comprising:

armature means disposed on that side of the magnetic core facing said movable contact springs, said movable contact springs being positively connected substantially in the middle thereof to an insulating body in an interior cavity thereof and carry contacts at both ends;

contact carrier means positively connected to said insulating body in the latter and register with the ends of said movable contact springs; and having soldering tags protruding from said insulating body, said armature being provided with actuating lugs, which register with the ends of said movable contact springs and are engageable with the latter by the movement of the armature; and wherein said insulating body includes a dust-shielding plate covering the interior cavity of said insulating body, which cavity accommodates the contact spring sets, and wherein said plate also separates the magnetic system from the contact spring sets and has openings through which the actuating lugs have access to the movable contact springs.

* * * * *